US008646756B2

(12) United States Patent
Mann

(10) Patent No.: US 8,646,756 B2
(45) Date of Patent: Feb. 11, 2014

(54) GATE

(75) Inventor: Ronald Leslie Mann, Sydney (AU)

(73) Assignee: Gram Engineering Pty Ltd. (AU)

( * ) Notice: Subject to any disclaimer, the term of this patent is extended or adjusted under 35 U.S.C. 154(b) by 0 days.

(21) Appl. No.: 12/857,040

(22) Filed: Aug. 16, 2010

(65) Prior Publication Data

US 2011/0049452 A1 Mar. 3, 2011

(30) Foreign Application Priority Data

Aug. 17, 2009 (AU) ..... 2009210365
Jan. 6, 2010 (AU) ..... 2010100000

(51) Int. Cl.
*E06B 11/02* (2006.01)

(52) U.S. Cl.
USPC ..... 256/73

(58) Field of Classification Search
USPC ..... 256/21, 24, 25, 59, 65.01, 65.02, 65.03, 256/65.04, 65.06, 65.11, 65.12, 73; 49/501, 49/50, 56
See application file for complete search history.

(56) References Cited

U.S. PATENT DOCUMENTS

| | | | | | |
|---|---|---|---|---|---|
| 16,419 | A * | 1/1857 | Wickersham | 256/70 |
| 3,395,489 | A * | 8/1968 | Banse | 49/381 |
| 4,188,019 | A * | 2/1980 | Meredith | 256/24 |
| 5,161,783 | A * | 11/1992 | German | 256/19 |
| 5,702,090 | A * | 12/1997 | Edgman | 256/19 |
| 5,713,171 | A * | 2/1998 | Andres | 52/263 |
| 6,041,486 | A * | 3/2000 | Forbis | 29/453 |
| 6,299,142 | B1 * | 10/2001 | Chaney et al. | 256/65.12 |
| 6,345,809 | B1 * | 2/2002 | Bebendorf | 256/24 |
| 6,779,781 | B2 * | 8/2004 | Bebendorf | 256/19 |
| 6,905,109 | B2 * | 6/2005 | Mills | 256/65.02 |
| 6,938,882 | B2 * | 9/2005 | Hadfield, Sr. et al. | 256/73 |
| 8,132,791 | B2 * | 3/2012 | Stucker | 256/19 |
| 2004/0140461 | A1 * | 7/2004 | Lappen | 256/24 |
| 2006/0113517 | A1 * | 6/2006 | Colantonio et al. | 256/24 |
| 2006/0273502 | A1 * | 12/2006 | Sade et al. | 269/41 |

FOREIGN PATENT DOCUMENTS

AU 2004221789 B2 9/2004

* cited by examiner

*Primary Examiner* — Joshua Kennedy
(74) *Attorney, Agent, or Firm* — Barnes & Thornburg LLP

(57) ABSTRACT

The gate (10) comprises a pair of opposite side frame members (20, 22) wherein each said side frame member has a respective aperture (32), the apertures being disposed opposite to one another. The gate also includes a pair of opposite end frame members (24, 26) and infill typically in the form of an infill panel (12) for restricting egress through the gate (10). The pair of end frame members (24, 26) span from one of the side frame members (20, 22) to the other of the side frame members (20, 22), and opposite ends of one of the end frame members are received in the apertures (32) of the side frame members. The end frame members and the side frame members form a peripheral frame about the infill panel (12), and at least one of the apertures (32) in the side frame members is dimensioned to form a space for permitting relative movement of the end frame members (24, 26) toward each other to fixedly hold the infill panel in position within the frame during assembly of the gate.

21 Claims, 7 Drawing Sheets

GATE

FIELD OF THE INVENTION

The invention relates to the field of fencing and in particular, to a gate and a method for assembly of the gate.

BACKGROUND OF THE INVENTION

Various types of fencing and gates are known in the art and metal fences are in widespread use in both commercial and domestic settings. Modern metal fences commonly comprise spaced apart posts linked by upper and lower rails, with infill panels positioned between the rails and posts to prevent access through the fence. The infill panels can be in the form of metal sheeting for privacy and/or security, or in more recent times, panels formed from a lattice network of interconnected metal slats. The infill panels can be received in longitudinal channels of consecutive ones of the posts, and can be further secured to the posts by mechanical fasteners.

Metal gates for use with these types of fences generally comprise an essentially matching panel of the fence. The manufacture of gates is generally a labour intensive process involving welding of the gate outer frame members together, typically at the corners of the frame. Welding can damage protective coatings such as zinc rich or other paint types at, and about, the weld area.

SUMMARY OF THE INVENTION

In an aspect of the present invention there is provided a gate, comprising:

a pair of opposite side frame members, each said side frame member having a respective aperture, the apertures being opposite to one another;

a pair of opposite end frame members spanning from one of the side frame members to the other of the side frame members, and opposite ends of one of the end frame members are received in the apertures of the side frame members; and infill means for restricting egress through the gate, the end frame members and the side frame members forming a peripheral frame about the infill means, and at least one of the apertures of the side frame members being dimensioned for permitting relative movement of the end frame members toward each other to fixedly hold the infill means in position within the frame.

Typically, at least one said aperture of the side frame members is oversized to permit the relative movement of the end frame members.

Typically, the end frame members sandwich the infill means in position.

Typically, a gate embodied by the invention further comprises a respective bracket disposed in an end of at least one of the side frame members to wedge the other of the end frame members in position in the side frame member. Each said bracket can have at least one leg wedged between the other of the end frame members and the respective side frame member. In at least some embodiments, each bracket has a web portion interconnecting a pair of opposite legs and straddles the respective end frame member such that the legs of the bracket are wedged either side of the end frame member.

Typically, each of the end frame members have a respective lengthwise channel, the channels being orientated toward one another, and the opposite edge margins of the infill means are received in the channels. At least one of the side frame members can also have a projecting tongue/spacer partly defining the aperture in that side frame member, the spacer being inserted into the channel of one of the end frame members.

Typically, the channels of the end frame members are dimensioned such that the opposite edge margins of the infill means are received in the channels in a snug fit.

Typically, the side frame members are provided with further opposing apertures, and opposite ends of the other said end frame member are received in the further apertures, preferably in a sliding fit.

Typically, the end frame members have essentially the same transverse cross-sectional profiles and dimensions.

Moreover, the side frame members of the gate can be tubular sections with opposite upper and lower open ends, and the upper ends of the tubular sections can be covered by respective covers fitted to the tubular sections. The tubular sections may have a square, rectangular or other suitable cross-sectional shape.

Typically, the infill means is adapted to resist a compressive load exerted on the infill means by the end frame members. This ability can be provided by one or more stiffening formations in the infill means that is/are orientated substantially perpendicularly to the end frame members. The stiffening formation(s) can be corrugations, ribs, bends, folded sections or the like.

The infill means can be an infill panel or other suitable means for restricting or preventing egress through the gate. Typically, the infill means is an infill panel fabricated from sheet material. In at least some embodiments, the infill means can be a lattice panel. When in the form of a sheet, the infill panel can have a stiffening formations (e.g., ribs or corrugations) providing a plurality of crests and troughs extending substantially the height of the infill panel. The crests and troughs may form a repeating pattern across the width of the sheet material. Typically, the infill means is fabricated from metal as are the side frame members and the end frame members.

In another aspect of the invention there is provided a fence incorporating at least one gate, the gate comprising:

a pair of opposite side frame members, each said side frame member having a respective aperture, the apertures being opposite to one another;

a pair of opposite end frame members spanning from one of the side frame members to the other of the side frame members, and opposite ends of one of the end frame members are received in the apertures of the side frame members; and infill means for restricting egress through the gate, the end frame members and the side frame members forming a peripheral frame about the infill means, and the infill having opposite edge margins, at least one of the apertures of the side frame members being dimensioned for permitting relative movement of the end frame members toward each other to fixedly hold the infill means in position within the frame.

In another aspect of the invention there is provided a method for assembling a gate, comprising:

providing a pair of side frame members and pair of end frame members, each of the side frame members having a respective aperture;

providing infill means for restricting egress through the gate, the infill means having opposite edge margins;

forming a peripheral frame about the infill means from the side frame members and the end frame members such that the end frame members span from one of the side frame members to the other of the side frame members and the apertures in the side frame members are opposite to one another, and opposite ends of one of the end frame members are received in the apertures, at least one of the apertures being dimensioned for permitting relative movement of the end frame members toward one another to fixedly hold the infill means in position between the end frame members; and locating the one said end frame member relative to the other end frame member to fixedly hold the infill means in said position.

In another aspect of the invention there is provided a method for assembling a gate, comprising:

providing a pair of side frame members and pair of end frame members, each of the side frame members having a respective aperture;

providing infill means for restricting egress through the gate, the infill means having opposite edge margins;

forming a peripheral frame about the infill means from the side frame members and the end frame members such that the end frame members span from one of the side frame members to the other of the side frame members and the apertures in the side frame members are opposite to one another, and opposite ends of one of the end frame members are received in the apertures, at least one of the apertures being dimensioned for permitting relative movement of the end frame members toward one another to fixedly hold the infill means in position between the end frame members;

locating the one said end frame member relative to the other said end frame member to fixedly hold the infill means in said position; and locating a bracket in an end of at least one of the side frame members to wedge the other of the end frame members in position in the side frame member.

In another aspect of the invention there is provided a gate assembly including a gate, the gate comprising:

a pair of opposite side frame members, each said side frame member having a respective aperture, the apertures being opposite to one another;

a pair of opposite end frame members spanning from one of the side frame members to the other of the side frame members, and opposite ends of one of the end frame members are received in the apertures of the side frame members; and infill means for restricting egress through the gate, the end frame members and the side frame members forming a peripheral frame about the infill means, and the infill means having opposite edge margins, at least one of the apertures of the side frame members being dimensioned for permitting relative movement of the end frame members toward each other to essentially fixedly hold the infill means in position within the frame.

Advantageously, methods as described herein can provide a simple and rapid method for assembly of a gate. The infill means can also be selected from a variety of different alternatives for aesthetic and/or security choices.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers, integers or steps.

All publications mentioned in this specification are herein incorporated by reference. Any discussion of documents, acts, materials, devices, articles or the like that has been included in this specification is solely for the purpose of providing a context for the invention. It is not to be taken as an admission that any or all of these matters form part of the prior art base or were common general knowledge in the field relevant to the invention as it existed in Australia or elsewhere before the priority date of this application.

The features and advantages of the invention will become further apparent from the following detailed description of embodiments thereof together with the accompanying drawings.

BRIEF DESCRIPTION OF THE ACCOMPANYING DRAWINGS

DETAILED DESCRIPTION OF EXEMPLARY EMBODIMENTS OF THE INVENTION

Figure 1:
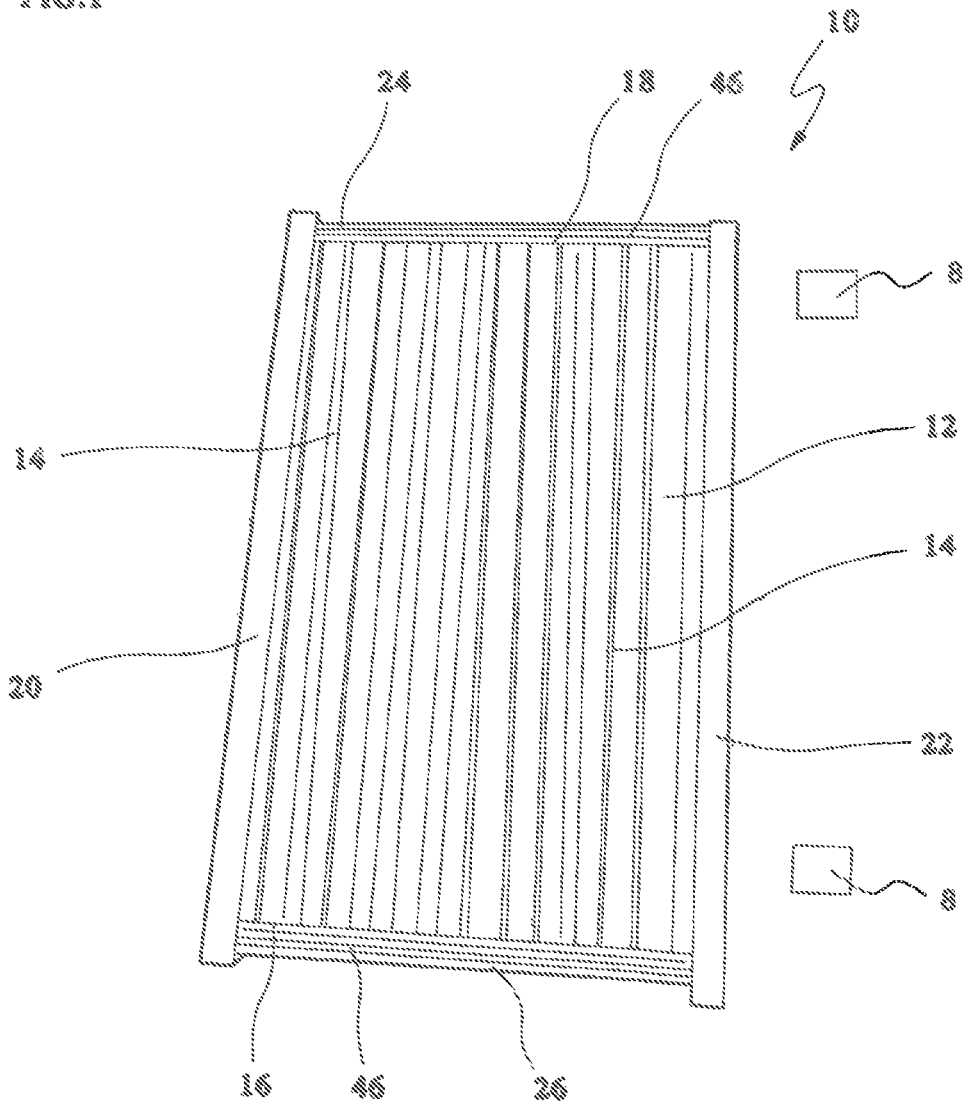
FIG. 1 is a front view of a gate embodied by the invention.

A metal gate 10 embodied by the invention is shown in FIG. 1. The gate 10 has an outer peripheral frame surrounding infill means in the form of an infill panel 12. The infill panel 12 has a plurality of longitudinal rib formations 14 extending from a lower edge margin of the panel indicated by the numeral 16 to its opposite edge margin 18 and which are spaced apart from one another across the width of the panel. The frame of the gate 10 is fabricated from tubular steel sections, and consists of a pair of opposed side frame members 20 and 22, an upper end frame member 24, and an opposite lower end frame member 26. The upper and lower end frame members each have a longitudinal channel 28, 30 (see FIG. 5) that receive the upper and lower edge margins of the infill panel 12 as described further below. Moreover, both the infill panel 12 and the respective frame members of the gate have a zinc-aluminium alloy coating with an exterior paint finish to protect them against corrosion.

Figure 2:
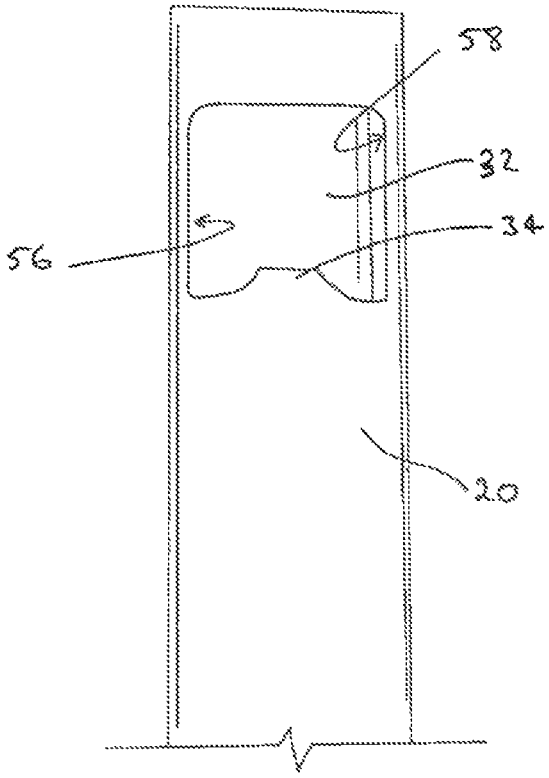
FIG. 2 is a partial side view of a side frame member of the gate of FIG. 1 with an aperture for receiving an end of an upper end frame member of the gate.
Figure 3:
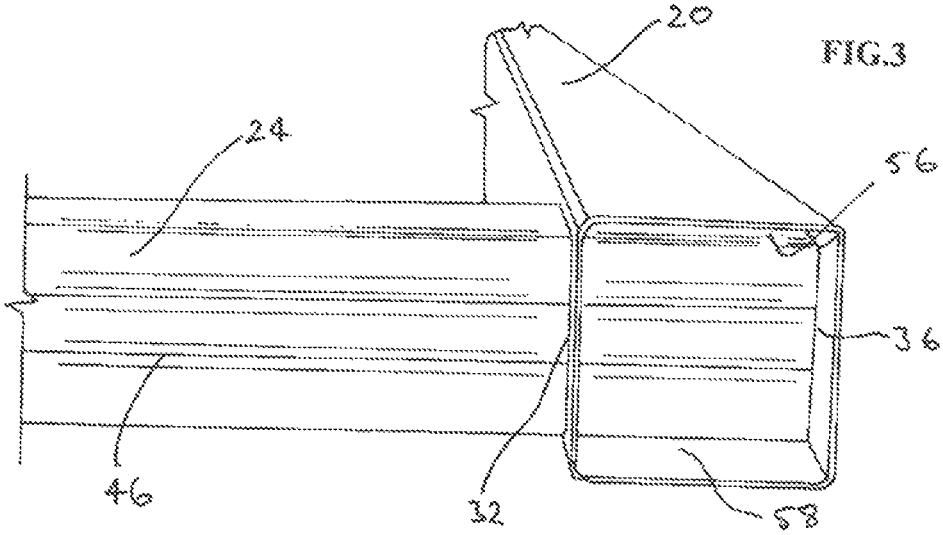
FIG. 3 is a partial end view of the upper end frame member inserted into the aperture of the side frame member of FIG. 2.
Figure 4:
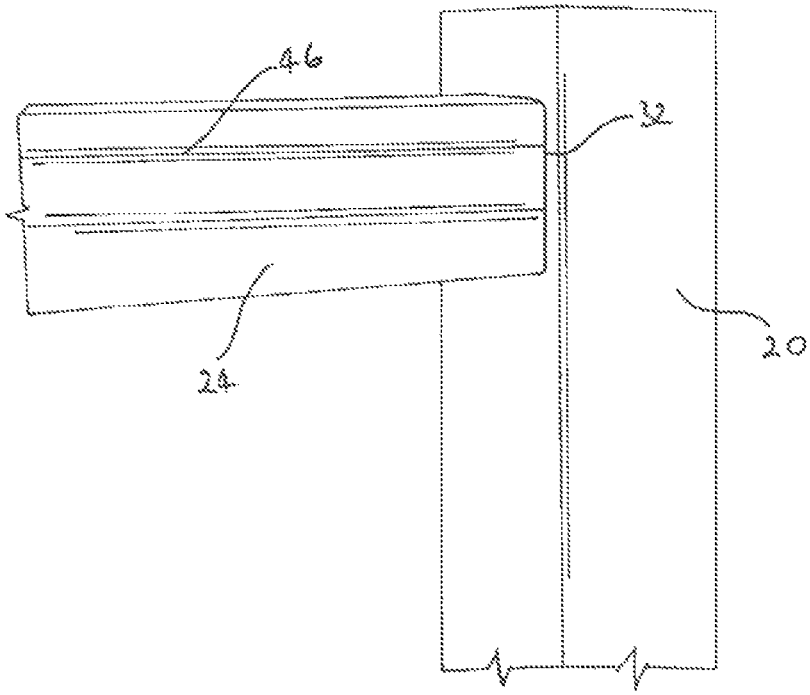
FIG. 4 is a partial perspective view of the side frame member of FIG. 3.

As better shown in FIG. 2, an aperture 32 is formed in the upper end region of each of the side frame members 20, 22 for reception of the upper end frame member 24. A tongue/spacer 34 defining a portion of the periphery of the aperture 32 is provided in each side frame member, and is received in the longitudinal channel 28 of the upper end frame member 24. Further, the opposite ends of the upper end frame member are in abutment with the inner face 36 of the respective side frame members and are received in the apertures 32 of those frame members in a sliding fit, thereby essentially locking the upper end frame member 24 in position in the lengthwise direction of the side frame members 20 and 22, as generally illustrated in FIG. 3.

Figure 6:
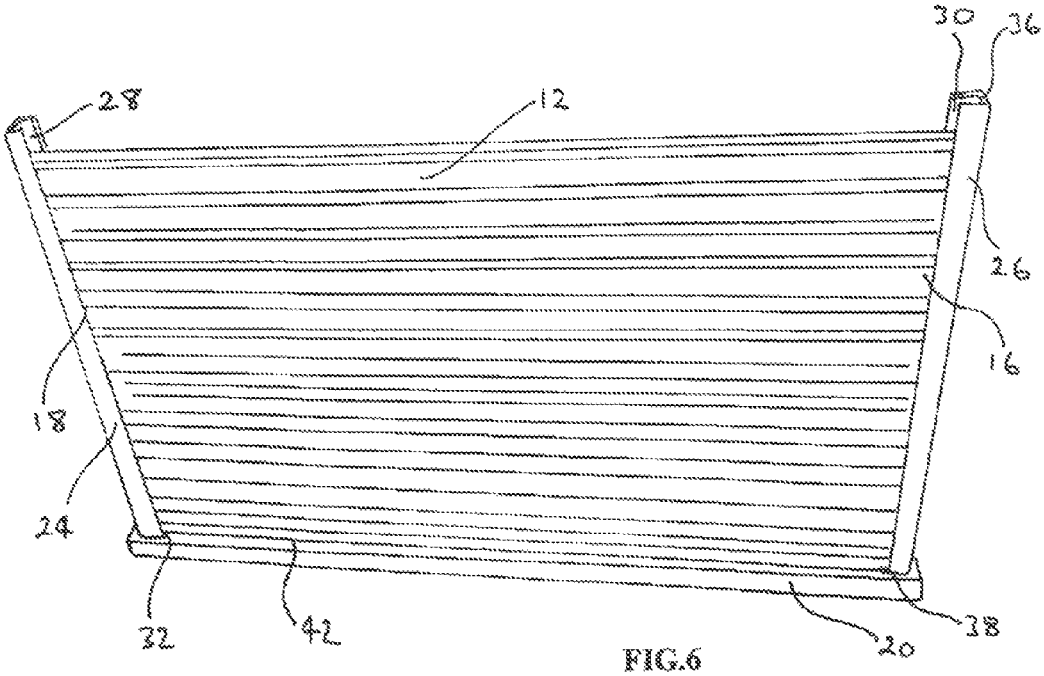
FIG. 6 is a front elevated view of the partially assembled gate of FIG. 5 showing an infill panel located between the upper and lower end frame members of the gate.
Figure 7:
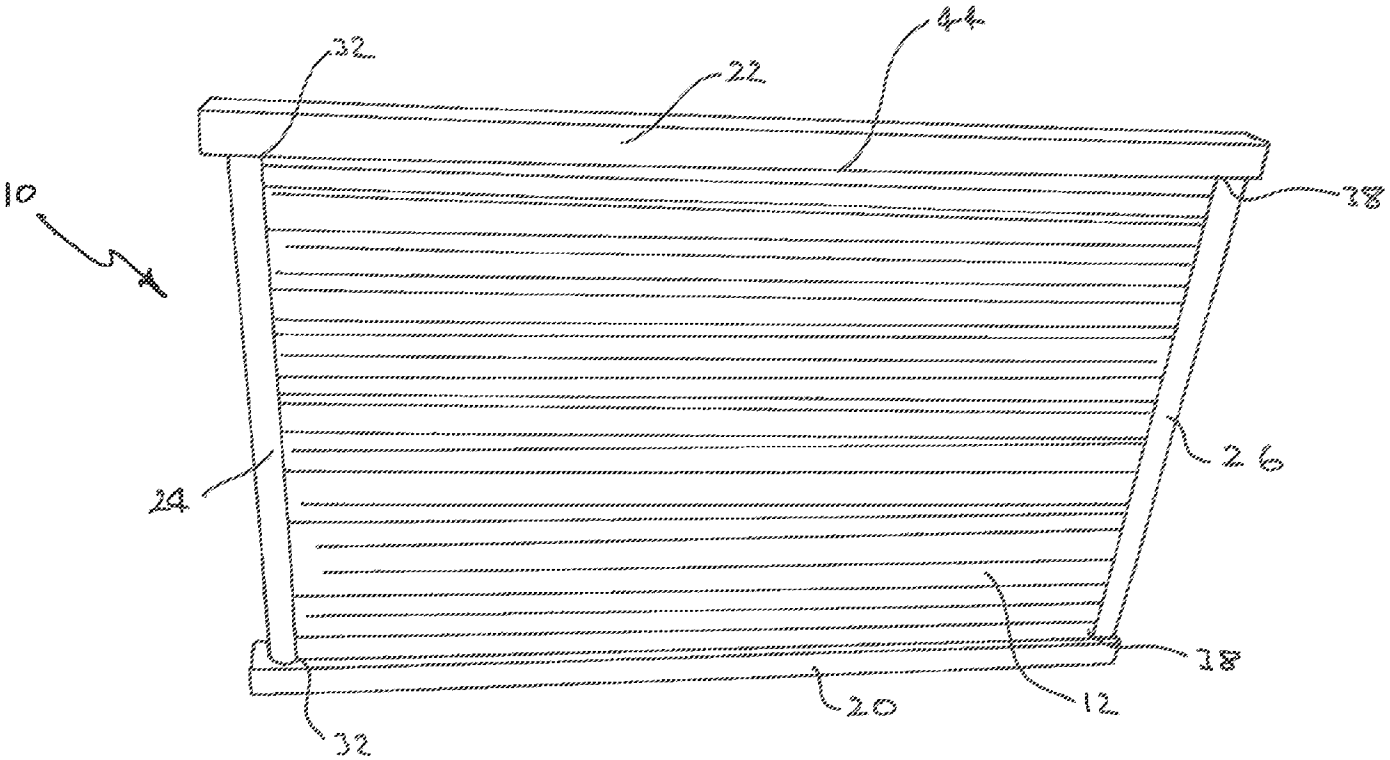
FIG. 7 is a further elevated view of the partially assembled gate of FIG. 6, in this instance illustrating the other of the side frame members being fitted.

Like apertures 38 are also formed in the opposite lower end regions 40 of the side frame members for reception of opposite ends of the lower end frame member 26 (see FIG. 7). However, at least one of the apertures 38 is oversized with respect to the lower end frame member 26 to permit relative movement of the upper and lower end frame members 24 and 26 toward each other during the assembly of the gate 10 as further described below. The assembly of the gate 10 is shown in FIG. 5 to FIG. 8.

Figure 5:
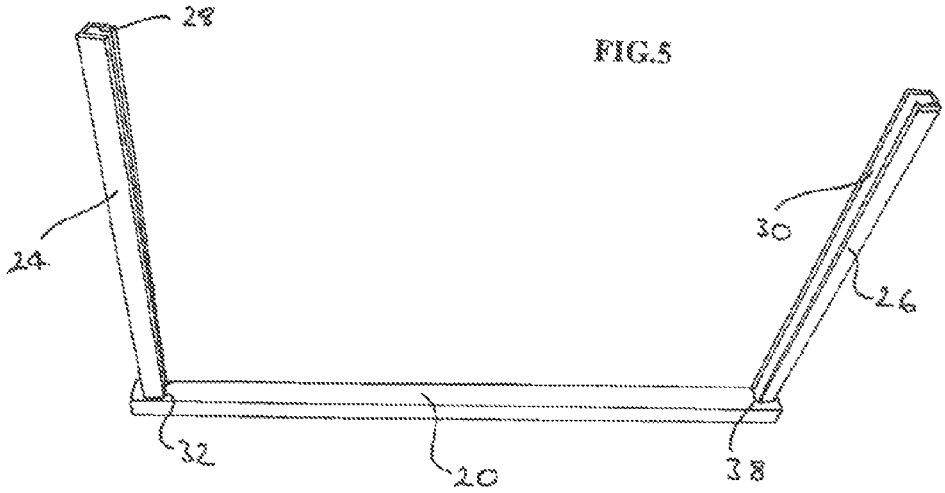
FIG. 5 is a front elevated view of the gate of FIG. 1 partially assembled.

Turning to FIG. 5 and FIG. 6, one of the side frame members 20 is initially laid on a flat surface, and the upper and lower end frame members 24 and 26 are inserted into the apertures 32 and 38 such that their longitudinal channels 28, 30 face toward each other. The opposite edge margins of the infill panel 12 are then inserted into the channels, and the panel 12 is slid down until the side edge 42 of the panel abuts the side frame member 20. The width of the longitudinal opening into the channels 28 and 30 is such that the opposite edge margins 16 and 18 of the panel 12 are received in the channels in a sliding contact fit whereby the panel 12 is restrained against lateral movement by the end frame members. The other side frame member 22 is then fitted as illustrated in FIG. 7 and specifically, the free end of the upper frame member 24 is inserted into upper aperture 32 of the side frame member 22 and the free end of the lower end frame member 26 is inserted into lower aperture 38, allowing side frame member 22 to be pressed toward the infill panel 12 into abutment with the side edge 44 of the infill panel.

Figure 8:
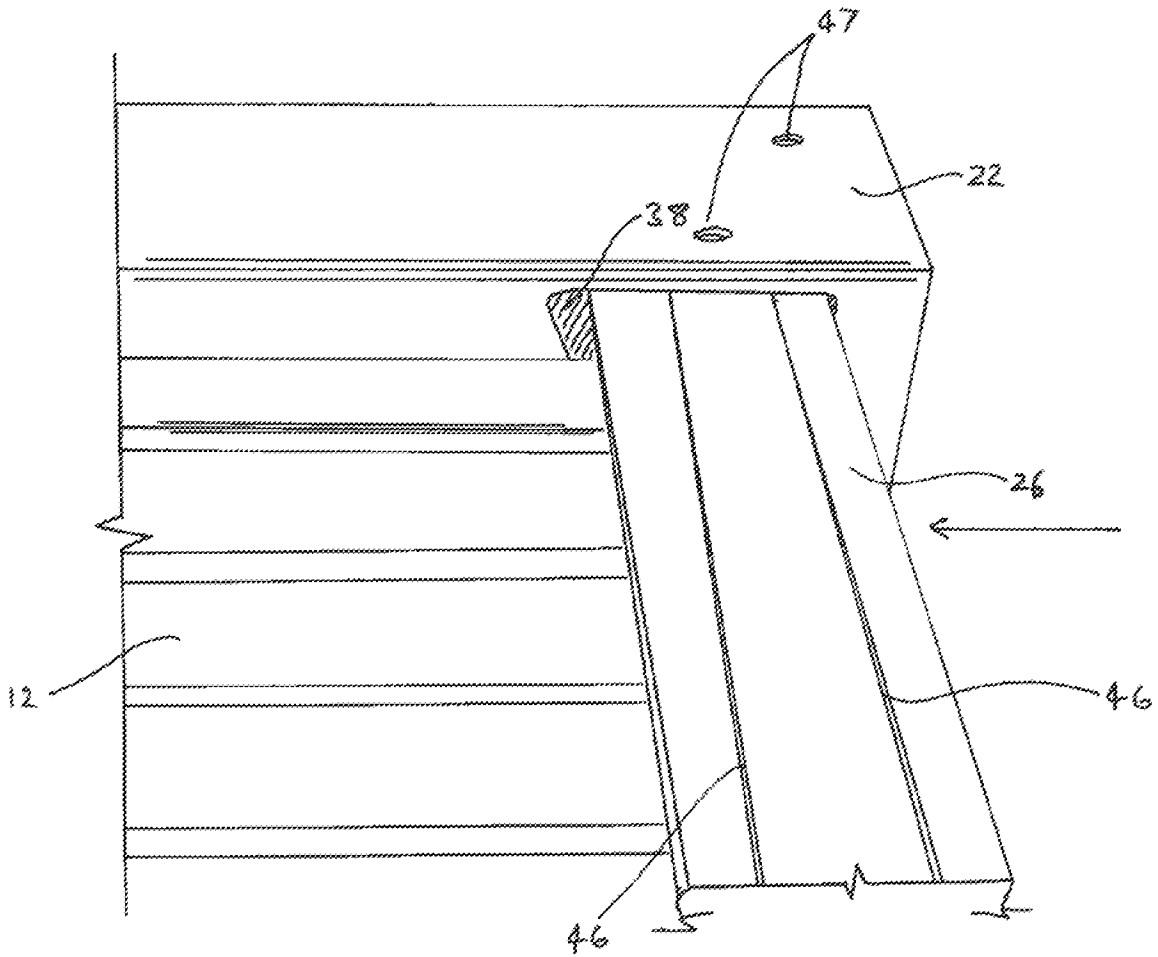
FIG. 8 is a partial front view of a lower end frame member of the gate of FIG. 7 inserted in an oversized aperture defined in the one of the side frame members of the gate.
Figure 9:
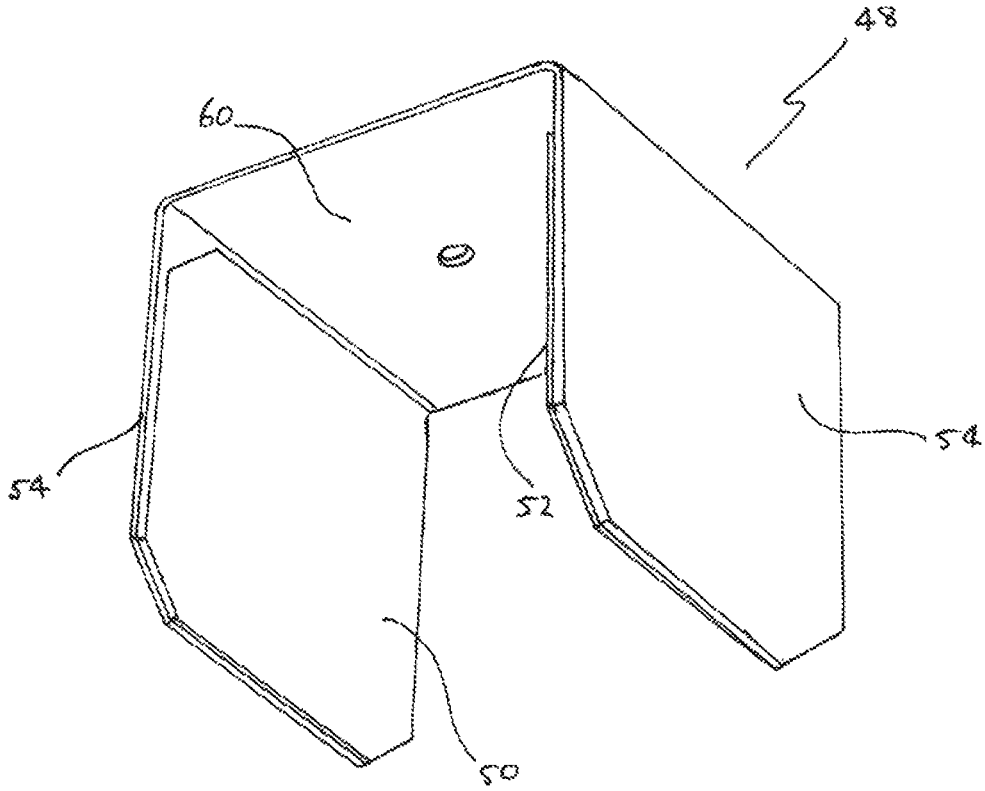
FIG. 9 is a perspective view of a bracket used in a gate embodied by the invention.

As shown in FIG. 8, at least one of the lower apertures 38 of the side frame members 20 and 22 is oversized relative to the lower end frame member 26. As such, the lower end frame member 26 can be driven toward the upper end frame member 24 by hand (or with the use of a rubber mallet or the like) as indicated by the arrow, to tightly sandwich the infill panel 12 between the upper and lower end frame members 24 and 26 against movement. When in this position, the lower side frame member 26 is then fixed at each end to the side frame members 20 and 22 by pop-riveting the frame members to one another through holes 47 pre-drilled in the opposite ends of the lower frame member, although other mechanical fasteners (e.g., screws can also be used).

Covers in the form of U-shaped brackets are fitted over the side frame members to cover their open upper ends, and the upper end frame member is also mechanically fastened (e.g., pop-riveted) to the side frame members as for the lower end frame member, fixing the covers in position. However, as will be understood, in other embodiments, plastic caps can instead be pressed onto the side frame members to close their open ends, and suitable mechanical fasteners other than pop-rivets (e.g., self tapping screws) can be used to fasten the gate together. Fixing the end frame members to the side frame members with mechanical fasteners adjacent the apertures 32 and 38 formed in the side frame members as described above provides rigidity to the gate thereby fixedly holding the infill panel 12 in position within the frame against movement or separation from the gate. Moreover, this is achieved without fastening the panel 12 to the peripheral frame.

In another embodiment, U-shaped end covers in the form of brackets 48 are inserted into the open top end of at least one of the side frame members 20 and 22 to close the end of those frame member(s). Typically, a respective bracket 48 is inserted in the open top end of each of side frame members 20 and 22. Each bracket 48 has a respective insert plate 50 and 52 spot welded to the inside of each of bracket legs 54 to increase the thickness of the legs. The legs 54 of the brackets 48 are wedged into the spaces 56 and 58 between the upper end frame member 24 and the side walls of the side frame members 20 and 22 (as best shown in FIG. 2 and FIG. 3) such that respective of the brackets straddle the upper end frame member 24. The brackets are driven into position with the use of a rubber mallet or the like such that the intermediate web portion 60 of each bracket is essentially flush with the end of the side frame members thereby providing the gate with a neat and attractive finish.

The wedging of the upper end frame member 24 by the brackets 48 locks the upper end frame member in position within the side frame members 20 and 22, essentially preventing the upper end member from being slid out of the side frame members. As such, it is not necessary to fasten the legs 54 of each bracket to the upper end frame member 24 using mechanical fastener(s) driven through the opposite side walls of side frame members as in the above described embodiments. Rather, a single mechanical fastener (e.g., a self tapping screw) can be driven into the upper end frame member (optionally through a pre-formed hole) in web portion 60 of each bracket to secure the brackets 48 to the upper end frame member. By filling the spaces 56 and 58 between the upper end frame member and the side frame members with the use of the brackets to thereby wedge the upper end frame member in position, the mechanical stability of the gate is enhanced. Of course, it is not necessary to spot weld side insert plates 50 to the legs 54 of the brackets 48 to increase the thickness of the legs for wedging of the upper end frame member, and each bracket 48 can be simply formed from sheet steel of the required thickness. Moreover, a protrusion can be provided on the inside face of at least one of the legs 54 of the bracket which projects toward the other leg for abutment with the side of the upper end frame member 24, to facilitate locating the bracket within the top open end of the corresponding side frame member 20 or 22 to the desired depth. The protrusion may, for example, be punched into the bracket from the opposite side of the leg during the fabrication of the bracket, or be provided by a small weld.

Rather than using a U-shaped bracket 48, a bracket provided with only a single leg 54 and web portion 60 can be used.

By constructing a gate embodied by the invention as described above, the gate can be rapidly pre-fabricated at the factory for delivery to the installation site or be assembled on site, the assembly of the gate being facilitated by the provision of pre-drilled holes in at least the side frame members 20 and 22 for mechanically fixing the peripheral frame of the gate together.

In addition, and as will be readily understood, the construction provides the gate with mechanical strength, which is enhanced by the provision of inverted longitudinal reinforcement ribs generally indicated by the numeral 46 in the top and opposing sides of the upper and lower end frame members 24 and 26. The rib formations 14 of the infill panel 12 likewise strengthen the panel against impact damage to either of its side faces, and provide resistance to compressive force exerted on the infill panel by the end frame members 24 and 26.

Various types of infill panels 12 can be utilised in a gate embodied by the invention. For instance, the panel can have differently shaped longitudinal reinforcement ribs forming alternating crests and troughs across the panel (e.g., corrugations, saw tooth profile etc.). Typically, the panel has a notional centre plane, the height of the crests and depth of the troughs being essentially the same distance from the centre plane. In particularly preferred embodiments, the pattern formed by the reinforcement ribs repeats across the panel. Alternatively, rather than being a sheet, the infill panel comprise interconnected metal slats forming a lattice of the type described in Australian patent application No. 2004221789, the contents of which is incorporated herein in its entirety by cross-reference. This type of infill panel can provide an aesthetic aspect when privacy is not a primary requirement.

In use, one of the side frame members of the gate is hinged 8 to a post (e.g., see FIG. 1) and a latch is fixed to the other side member for securing the gate to another post disposed adjacent to that side frame member, in the conventionally known manner. Any suitable such latching mechanism/system can be employed.

The gate body formed by the outer peripheral frame and infill means as described above can be used for purposes other than as a gate such as a segment of a fence, as a partition or divider between two adjacent (e.g., building) structures, or as a screen for screening off an enclosure (e.g., for placement of garbage bins) or the like, and the invention expressly extends to the gate body itself. When used as a fence panel, the gate body can be held upright (typically elevated from the ground surface) by H-section fence posts, the gate body being disposed between consecutive ones of the fence posts and secured between the opposing side flanges of respective of the posts.

Although the invention has been described with reference to a number of embodiments, it will be understood that numerous various and modifications can be made to them without departing from the scope of the invention and as such, the described embodiments are merely illustrative and not restrictive.

The invention claimed is:

1. A gate, comprising:

a pair of opposite side frame members, each said side frame member having a respective aperture, the apertures being opposite to one another;

a pair of opposite end frame members spanning from one of the side frame members to the other of the side frame members, and opposite ends of one of the end frame members are received in the apertures of the side frame members; and infill means for restricting egress through the gate, the infill means having opposite upper and lower terminal end edges, and the end frame members and the side frame members forming a peripheral frame about the infill means, and wherein at least one of the apertures of the side frame members is a hole dimensioned such that a space is provided between a surface of one of the opposite ends of one of the end frame members located within the hole and an edge of the hole to allow driving movement of the one of the opposite ends of the end frame members toward the other of the end frame members and against the corresponding said edge of the infill means such that the opposite said end edges of the infill means are in pressed contact with the end frame members and the infill means is thereby sandwiched between the end frame members to fixedly hold the infill means in position within the frame during assembly of the gate, and fixing means for retaining the end frame members being retained in said pressed contact with the infill means and the peripheral frame of the gate being hinged to a post for opening and closing of the gate.

2. A gate according to claim 1 further comprising a respective bracket disposed in an end of at least one of the side frame members to wedge the said one of the end frame members in position in the side frame member.

3. A gate according to claim 2 wherein said one of the end frame members is a lower end frame member and the other end frame member is an upper end frame member, and each said side frame member has a further aperture, the further apertures being opposite to one another and receiving a respective end of the upper end frame member, wherein each said bracket has at least one leg wedged between the upper end frame member and the respective said side frame member, and the at least one aperture receiving the lower end frame member is oversized relative to the lower end frame member.

4. A gate according to claim 3 provided with a pair of the brackets, wherein each bracket has a web portion interconnecting a pair of the legs and straddles the upper end frame member such that one of the legs is disposed to one side of the upper end frame member and the other of the legs is disposed to an opposite side of the upper end frame member, one of the brackets being disposed in a top said end of one of the side frame members and the other of the brackets being disposed in a top said end of the other said side frame member, and each of the brackets is fastened to the upper end frame member by a fastener passing through the web portion of the respective said bracket into the upper end frame member.

5. A gate according to claim 1 wherein the at least one said aperture of the side frame members is oversized to permit the relative movement of the end frame members.

6. A gate according to claim 1 wherein each of the end frame members have a respective lengthwise channel, the channels being orientated toward one another, and the opposite edge margins of the infill means are received in the channels.

7. A gate according to claim 6 wherein the opposite edge margins of the infill means are received in the channels of the end frame members in a snug fit.

8. A gate according to claim 6 wherein at least one of the side frame members has a projecting spacer portion partly defining the aperture in that side frame member, the spacer portion being inserted into the channel of one of the end frame members.

9. A gate according to claim 1 wherein the side frame members are provided with further opposing apertures, and opposite ends of the other said end frame member are received in the further apertures.

10. A gate according to claim 9 wherein the opposite ends of the other said end frame member are received in the further apertures in a snug fit.

11. A gate according to claim 1 wherein the end frame members have the same transverse cross-sectional profile and dimensions.

12. A gate according to claim 1 wherein the infill means is an infill panel.

13. A gate according to claim 12 wherein the infill panel is fabricated from sheet material.

14. A gate according to claim 13 wherein the sheet material is sheet steel.

15. A gate according to claim 12 wherein the infill panel is a lattice panel.

16. A gate according to claim 12 wherein the infill panel has a plurality of crests and troughs extending the height of the infill panel.

17. A gate according to claim 16 wherein the crests and troughs form a repeating pattern across the width of the sheet material.

18. A fence incorporating at least one gate, the gate comprising:

a pair of opposite side frame members, each said side frame member having a respective aperture, the apertures being opposite to one another;

a pair of opposite end frame members spanning from one of the side frame members to the other of the side frame members, and opposite ends of one of the end frame members are received in the apertures of the side frame members; and infill means for restricting egress through the gate, the end frame members and the side frame members forming a peripheral frame about the infill means, and the infill means having opposite edge margins, at least one of the apertures of the side frame members is a hole dimensioned such that a space is provided between a surface of one of the opposite ends of one of the end frame members located within the hole and an edge of the hole to allow driving movement of the one of the opposite ends of the end frame members toward the other of the end frame members and into pressed contact with the infill means and thereby sandwich the infill means between the opposite said end frame members to fixedly hold the infill means in position within the peripheral frame during assembly of the gate, and fixing means for retaining the end frame members in said pressed contact with the infill means and the peripheral frame of the gate being hinged to a post of the fence for opening and closing of the gate.

19. A fence according to claim 18 further comprising a respective bracket disposed in an end of at least one of the side frame members to wedge said one of the end frame members in position in the side frame member.

20. A method for providing a gate, comprising:

providing a pair of side frame members and pair of end frame members, each of the side frame members having a respective aperture;

providing infill means for restricting egress through the gate, the infill means having opposite upper and lower terminal end edges;

forming a peripheral frame about the infill means from the side frame members and the end frame members such that the end frame members span from one of the side frame members to the other of the side frame members and the apertures in the side frame members are opposite to one another, and opposite ends of one of the end frame members are received in the apertures, at least one of the apertures is a hole dimensioned such that a space is provided between a surface of one of the opposite ends of one of the end frame members located within the hole and an edge of the hole to allow driving movement of the one of the opposite ends of the end frame members toward the other said end frame member for fixedly holding the infill means in position between the end frame members; and driving the one said end frame member against the corresponding edge of the infill means such that the opposite end edges of the infill means are in pressed contact with the end frame members and the infill means is thereby sandwiched between the end frame members to fixedly hold the infill means in said position;

securing said one end frame member in position with fixing means so that the end frame members are retained in said pressed contact with the infill means; and installing the gate for opening and closing of the gate.

21. A method according to claim 20 wherein said securing comprises locating a respective bracket in an end of at least one of the side frame members to wedge said one of the end frame members in said position.

* * * * *